US009349555B2

(12) United States Patent
Yang

(10) Patent No.: US 9,349,555 B2
(45) Date of Patent: May 24, 2016

(54) CURRENT LIMITED ELECTRICAL DEVICES, ELECTRICAL DEVICE CONTACT ASSEMBLIES, AND OPERATIONAL METHODS

(71) Applicant: Siemens Industry, Inc., Alpharetta, GA (US)

(72) Inventor: Guang Yang, Suwanee, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 0 days.

(21) Appl. No.: 14/326,773

(22) Filed: Jul. 9, 2014

(65) Prior Publication Data

US 2016/0012990 A1 Jan. 14, 2016

(51) Int. Cl.

| | |
|---|---|
| ***H01H 33/18*** | (2006.01) |
| ***H01H 33/08*** | (2006.01) |
| ***H01H 9/44*** | (2006.01) |
| ***H01H 71/02*** | (2006.01) |

(52) U.S. Cl.

CPC ..... *H01H 33/18* (2013.01); *H01H 9/44* (2013.01); *H01H 33/08* (2013.01); *H01H 71/0228* (2013.01)

(58) Field of Classification Search

CPC ... H01H 2003/225; H01H 9/44; H01H 9/446; H01H 33/18; H01H 33/185

USPC ..... 218/22, 27, 28, 141; 335/136, 149, 162, 335/201, 226; 361/14, 143

See application file for complete search history.

(56) References Cited

U.S. PATENT DOCUMENTS

| | | | | |
|---|---|---|---|---|
| 2,411,892 | A | 12/1946 | Gerhard | |
| 2,411,893 | A | 12/1946 | Peters | |
| 2,501,323 | A * | 3/1950 | Frink | 361/14 |
| 3,467,799 | A * | 9/1969 | Knecht et al. | 218/27 |
| 3,889,082 | A * | 6/1975 | McFarland | 218/15 |
| 4,302,644 | A * | 11/1981 | Arvisenet | 218/23 |
| 4,451,718 | A * | 5/1984 | Yamagata et al. | 200/147 R |
| 4,654,614 | A * | 3/1987 | Chien et al. | 335/201 |
| 5,185,590 | A * | 2/1993 | DiVincenzo | 335/201 |
| 5,837,954 | A * | 11/1998 | Asakawa et al. | 218/40 |
| 2004/0113620 | A1 * | 6/2004 | Tsuda et al. | 324/320 |
| 2012/0037598 | A1 * | 2/2012 | Fasano | 218/22 |
| 2012/0261382 | A1 * | 10/2012 | Fasano | 218/23 |
| 2013/0271257 | A1 | 10/2013 | Yang | |

FOREIGN PATENT DOCUMENTS

| | | |
|---|---|---|
| DE | 1206066 B | 12/1965 |
| DE | 8620645 U1 | 1/1988 |

OTHER PUBLICATIONS

European Search Report mailed Dec. 4, 2015 corresponding to European Application No. 15175254.0 filed Jul. 3, 2015 (10 pages).

* cited by examiner

*Primary Examiner* — Renee S Luebke
*Assistant Examiner* — William Bolton

(57) ABSTRACT

Electrical device contact assemblies with separable electrical contacts exhibiting enhanced arcing constriction are disclosed. Electrical device contact assembly includes first and second electrical contacts separable along a separation path, and a magnetic field generator configured as part of a line conductor that is operable to produce a magnetic field that acts on the separation path during a short circuit event. Electrical devices including the electrical device contact assembly and methods of operating the electrical device contact assembly are provided, as are other aspects.

17 Claims, 5 Drawing Sheets

CURRENT LIMITED ELECTRICAL DEVICES, ELECTRICAL DEVICE CONTACT ASSEMBLIES, AND OPERATIONAL METHODS

FIELD

The present invention relates generally to electrical devices such as circuit breakers, and more particularly to limiting current in electrical contact assemblies for such electrical devices.

BACKGROUND

In general, an electrical interrupt device (e.g., a circuit breaker) operates to engage and disengage a selected electrical circuit from an electrical power supply. The electrical interrupt device ensures current interruption thereby providing protection to the electrical circuit from unwanted electrical conditions, such as continuous over-current conditions and high current transients due, for example, to electrical short circuits. Such electrical interrupt devices operate by separating a pair of internal electrical contacts contained within a housing of the electrical interrupt device.

Typically, one electrical contact is stationary, while the other is movable. Conventional circuit breakers may include a moving electrical contact mounted on an end of a moving (e.g., pivotable) contact arm, such that the moving electrical contact moves through a separation path. Contact separation between the moving and stationary electrical contacts may also occur manually, such as by a person throwing a handle of a circuit breaker or other electrical interrupt device. This throw action may engage an operating mechanism, which may be coupled to the contact arm and the moveable movable contact. Otherwise, the electrical contacts may be separated automatically when an persistent over-current condition or a short circuit condition is encountered. This automatic tripping may be accomplished by a tripping mechanism actuated via an overload element (e.g., a bimetal element and/or a magnet).

Upon contact separation of the electrical contacts by tripping (manual or automatic) of the circuit breaker, a substantial electrical arc may be formed between the electrical contacts. It is desirable to extinguish this electrical arc as quickly as possible to avoid damaging internal components of the electrical interrupt device. However, in previous devices such as circuit breakers, for example, although extinguishment of such arcs has been effective, the arc may not have been extinguished as rapidly as desired.

Accordingly, there is a need for electrical interrupt devices, electrical device contact assemblies, and methods of operating electrical interrupt devices that offer better arc extinguishment following electrical contact separation.

SUMMARY

According to a first aspect, an electrical device contact assembly is provided. The electrical device contact assembly includes a first electrical contact, a second electrical contact separable from the first electrical contact along a separation path, and a magnetic field generator configured as part of a line conductor that is operable to produce a magnetic field acting on the separation path during a short circuit event.

In accordance with another aspect, an electrical device is provided. The electrical device includes a housing including walls forming an arc chamber, a first electrical contact within the arc chamber, a second electrical contact within the arc chamber and separable from the first electrical contact along a separation path, and a magnetic field generator positioned adjacent to the arc chamber, the magnetic field generator configured as part of a line conductor and operational to produce a magnetic field acting on the separation path during a short circuit event.

In accordance with another aspect, a method of operating an electrical device contact assembly is provided. The method includes providing a first electrical contact and a second electrical contact separable from the first electrical contact along a separation path, providing a magnetic field generator configured as part of a line conductor, and generating with the magnetic field generator a magnetic field acting on the separation path during a short circuit event.

Still other aspects, features, and advantages of the present invention may be readily apparent from the following detailed description by illustrating a number of example embodiments and implementations, including the best mode contemplated for carrying out the present invention. The present invention may also be capable of other and different embodiments, and its several details may be modified in various respects, all without departing from the scope of the present invention. Accordingly, the drawings and descriptions are to be regarded as illustrative in nature, and not as restrictive. The invention is to cover all modifications, equivalents, and alternatives falling within the scope of the invention.

DETAILED DESCRIPTION

Figure 1:
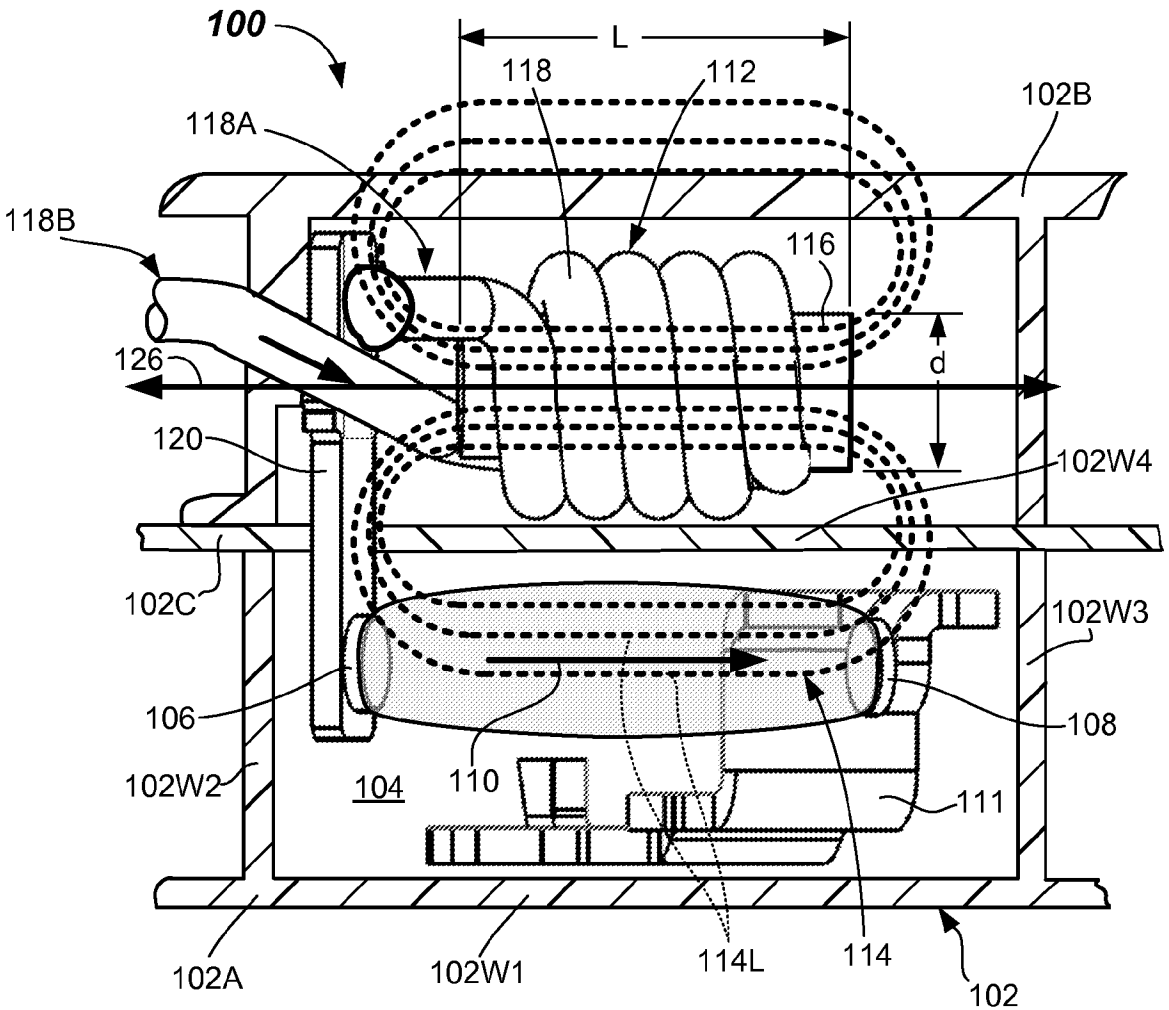
FIG. 1 illustrates a partial side cross-sectioned view of an electrical device contact assembly of an electrical device according to embodiments.

In view of the foregoing difficulties in extinguishing the arc, there is a need to extinguish an electrical arc in such electrical circuit interrupt devices (e.g., circuit breakers, and the like) as soon as possible after physical separation of the electrical contacts occurs. Such separation may be due to a circuit interruption event such as an electrical short circuit, or even manual tripping where a user remotely or manually opens the electrical contacts. According to one or more embodiments of the invention, an improved electrical device contact assembly for an electrical device (e.g., circuit breaker, or the like) including arc current limiting is provided.

The electrical device contact assembly includes a first electrical contact and a second electrical contact being separable from the first electrical contact along a separation path. The contacts may be contained in an arc chamber of a housing. Electrical device contact assembly includes a magnetic field generator positioned proximate to the first and second electrical contacts and adapted to produce a magnetic field thereat. The magnetic field has field lines that act substantially parallel to a separation path of the electrical contacts. The produced magnetic field acts on the arc to substantially limit the arc current due to electrical contact separation.

In one or more embodiments, the magnetic field is produced by the magnetic field generator comprising a core and a coil of wire wound about the core. The coil of wire may electrically connect between a first electrical contact (e.g., the stationary contact) and the line power input of the electrical device. Thus, the magnetic field is produced by the high current passing through the coil during an interrupt event.

The principles of the present invention are not limited to the illustrative examples depicted herein, but may be applied and utilized in any type of electrical device including an electrical contact assembly, whether included in a mechanical or electronic device. For example, embodiments of the present invention may be useful in single-pole circuit breakers, duplex circuit breakers, two-pole circuit breakers, multi-pole circuit breakers, ground fault circuit interrupters (GFCI), arc fault circuit interrupters (AFCI), surge protective devices (TVSS), metering circuit breakers, electronic trip unit breakers, remotely-controllable circuit breakers, switches, and the like.

These and other embodiments of the electrical device contact assembly, electrical devices containing an electrical device contact assembly and methods of operating the electrical device contact assembly according to the present invention are described below with reference to FIGS. 1-5 herein. Like reference numerals used in the drawings identify similar or identical elements throughout the several views. The drawings are not necessarily drawn to scale.

Referring now to FIG. 1, a first embodiment of electrical device contact assembly 100 is shown in isolation. Electrical device contact assembly 100 is included in an electrical device. The electrical device contact assembly 100 includes a housing 102, which may be molded case housing (e.g., a molded circuit breaker housing) made from a suitable polymer or plastic material, for example. The material may be a thermoset material, such as a glass-filled polyester, or a thermoplastic material such as a Nylon material (e.g., Nylon 6), for example. Other suitable housing materials may be used. Housing 102 may be made up of two more parts (e.g., first housing part 102A, second housing part 102B, and intermediate housing part 102C) in some embodiments, which are connected together using fasteners (e.g., screws, rivets, or the like). Housing 102 may include walls 102W1, 102W2, 102W3, 102W4 that may interface to form an arc chamber 104. First, second, and intermediate housing parts 102A-102C shown may comprise only a portion of the housing 102 (other portions not shown in FIG. 1).

Electrical device contact assembly 100 includes a first electrical contact 106 which is generally located within the arc chamber 104, and a second electrical contact 108 also generally located within the arc chamber 104. First electrical contact 106 and second electrical contact 108 are separable from each other, and may comprise conventional contact construction. Separation may be along a separation path 110 between the first electrical contact 106 and the second electrical contact 108, such as separation path 110 illustrated by the directional arrow.

In the depicted embodiment, first electrical contact 106 may be a stationary electrical contact, whereas the second electrical contact 108 may be a moveable electrical contact. However, the invention will work equally well in embodiments where both the first electrical contact 106 and the second electrical contact 108 are both moveable contacts. In the illustrated embodiment, the second electrical contact 108 is shown coupled to a moveable contact arm 111. Moveable contact arm 111 may be of any conventional construction, and is generally pivotable responsive the interrupt event to cause separation along the separation path 110.

Electrical device contact assembly 100 includes a magnetic field generator 112 that is positioned proximate to the first electrical contact 106 and the second electrical contact 108. Magnetic field generator 112 is configured and operable to produce a magnetic field 114 having sufficient magnetic field strength to cause a constriction of the arc. Magnetic field lines 114L (a few labeled) are produced and are oriented such that portions are substantially parallel to the separation path 110 along at least some of the separation path 110. Some deviations from tolerable, such as up to about +/−10 degrees, or even +/−15 degrees. Magnetic field generator 112 may be located in the second housing part 102B in the depicted embodiment.

It should be recognized that the first electrical contact 106 and the second electrical contact 108 reside in the first housing part 102A of housing 102 (e.g., a first side), and the magnetic field generator 112 may be located in the second housing part 102B of housing 102 (e.g., a second side) in this embodiment (e.g., in a side-by-side orientation across a width of the electrical device). The intermediate housing part 102C may form a wall 102W4 between the first electrical contact 106 and the second electrical contact 108 in the first housing part 102A, and the magnetic field generator 112 in the second housing part 102B. In operation, magnetic field generator 112 in one side of the housing 102 produces the magnetic field lines in another side of the housing 102.

Magnetic field generator 112 may include a core 116 and a coil of wire 118 wound about the core 116. The core 116 may be a magnetically susceptible metal material such as steel (e.g., low-carbon steel) or iron material. For example, core 116 may be a 1006, 1008, or 1010 steel. In other embodiments, core 116 may be a powdered iron material. Core 116 may have a rod shape in some embodiments, and may have a diameter "d" between about 0.1 inch and about 0.3 inch (between about 2.5 mm and about 7.6 mm), or even between about 0.15 inch to about 0.25 inch (between about 3.8 mm and about 6.4 mm). Core 116 may have a length "L" of between about 0.15 inch and about 1.0 inch (between about 3.8 mm and about 25.4 mm). Other "d" and "L" dimensions and shapes of the core 116 may be used.

The coil of wire 118 may be a 16 gauge wire, and may include polymer insulation thereon. The number of coils wrapped around the core 116 may between about two and about six, and about five in some embodiments. However, the number of coils may vary depending on the current that is present in the main current path during an interruption event (e.g., short circuit). Current in the main current path during a short circuit interrupt event may be 200 A to 4K amp, for example.

On one end, the coil of wire 118 that is wound about the core 116 may be electrically connected to the first electrical contact 106. For example, a first end 118A of a wire conductor 227 extending from the coil of wire 118 may be brazed to the contact support 120. Contact support 120 may be received in a pocket of the housing 102, for example, or may otherwise be fixed to the housing 102. Contact support 120 includes the first electrical contact 106 thereon. On a second end 118B, an extension of the wire conductor 227 from the coil of wire 118 that is wound about the core 116 may be electrically connected to a line connector 222 as shown in FIGS. 2A and 2B.

Line connector 222 may be configured to electrically couple to a source of line power, such as to a conductor within a panel box, or the like. For example, line connector 222 may be a spring clip (e.g., a C-shaped clip) that may be retained in the housing 102 (e.g., between first and second housing parts 102A, 102B) and configured and adapted to secure to a stab in a panel box or electrical enclosure. In another embodiment, the line connector 222 may be a metal bar or strip, which may include one or more fastener holes adapted to couple to a conductive line power component, or the like. Other suitable structures for the line connectors 222 may be used.

Figure 2A:
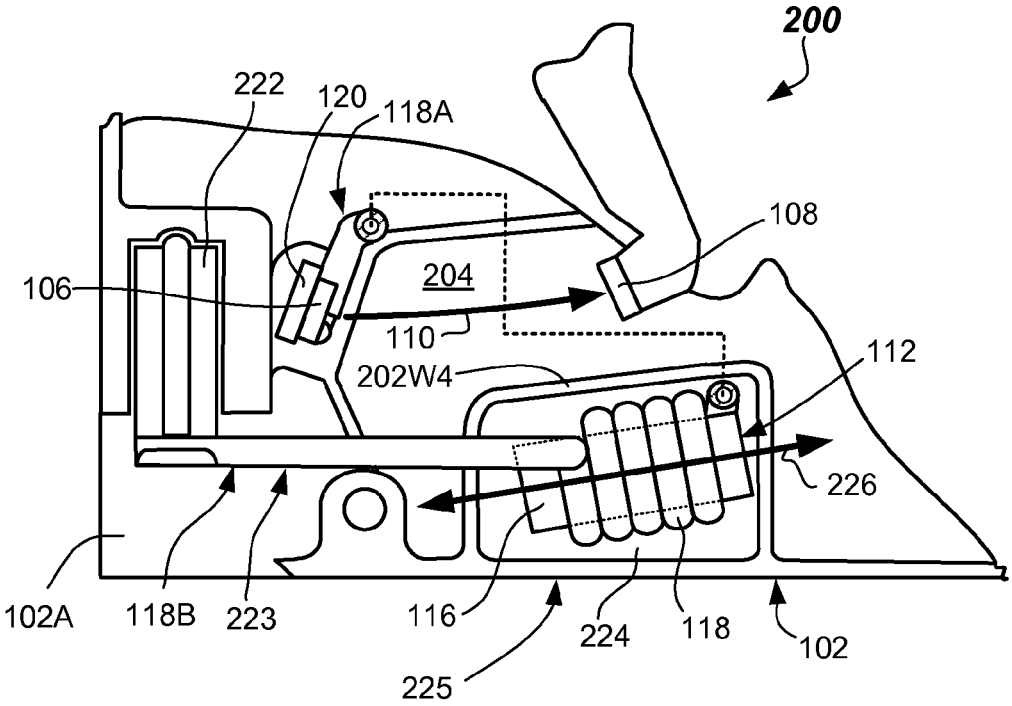
FIG. 2A illustrates a partial side plan view of some components of an electrical device including an electrical device contact assembly according to embodiments.
Figure 2B:
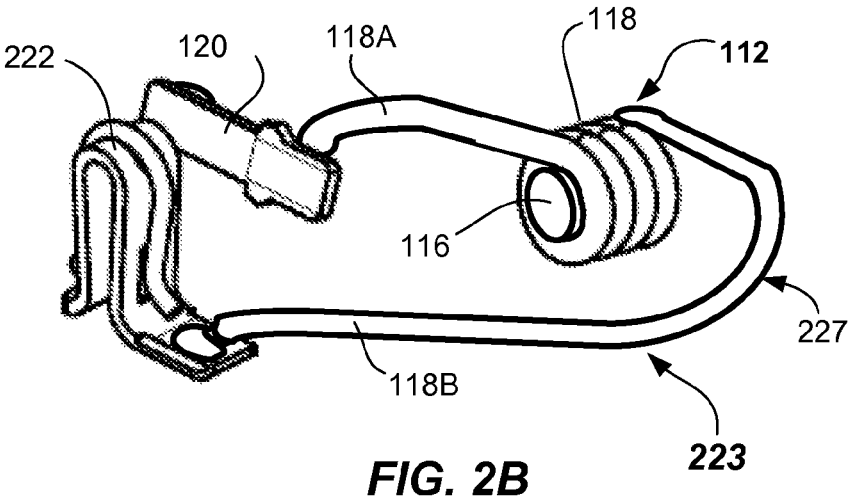
FIG. 2B illustrates a perspective view of magnetic field generator formed as part of a line conductor according to embodiments.
Figure 3:
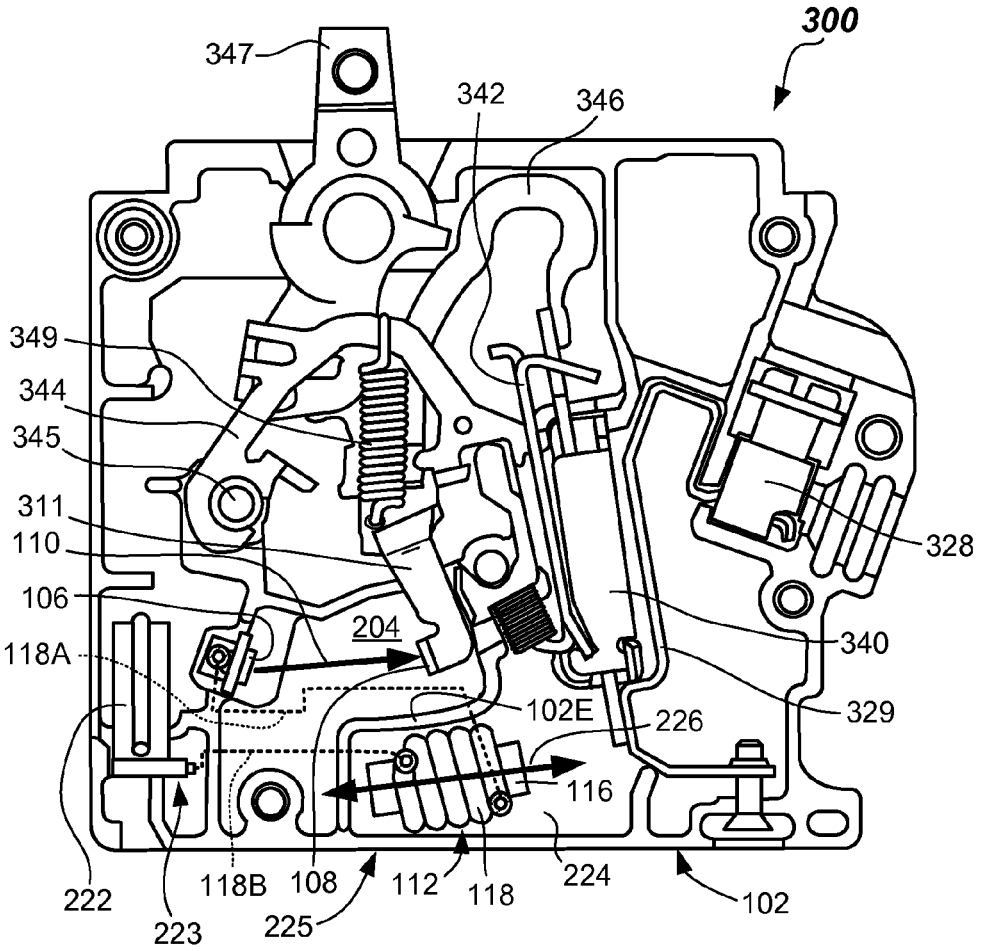
FIG. 3 illustrates a side plan view of a first part of a circuit breaker including an electrical device electrical contact assembly according to embodiments.

In the embodiments of FIGS. 2A-2B and 3, the magnetic field generator 112 may be confined to a side chamber 224 formed within or by parts of the housing 102. The side chamber 224 may be located adjacent to, and in close proximity to, the arc chamber 204 in one or more embodiments. Arc chamber 204 includes the first and second electrical contacts 106, 108 therein. In this and other embodiments, there may be a separating wall 202W4 provided between the location of the first and second electrical contacts 106, 108 and the magnetic field generator 112. Separating wall 102W4 may form a part of the arc chamber 204 and a part of the side chamber 224 in some embodiments. The separating wall 102W4 may shield the portion of the line conductor 223 that is located within the side chamber 224 (e.g., the coil of wire 118 and portions of the first and second ends 118A, 118B). The remainder of the line conductor 223 may pass through another part of the housing 102, which is separated from the first housing part 102A of the housing 102 shown.

As best shown in FIG. 2B, line conductor 223, which may be a separate assembly, includes the contact support 120, first end 118A of wire conductor 227 connected to contact support 120, coil of wire 118 formed as part of the wire conductor 227, and second end 118B of wire conductor 227 electrically connected to the line connector 222. Electrical connections may be by braising or the like. Magnetic field generator 112 is configured as part of the line conductor 223.

In the depicted embodiment of FIGS. 2A and 2B and 3, the magnetic field generator 112 may situated at the bottom 225 of the housing 102 of the electrical device (e.g., opposite the handle 347 in the circuit breaker or other device), and may be mounted below (as shown) the arc chamber 204. The magnetic field generator 112 may be situated in the same part (e.g., in first housing part 102A) of the electronic device as the arc chamber 204 in some embodiments, such as shown in FIGS. 2A and 3.

In each embodiment, such as shown in FIGS. 1, 2A and 3, the core 116 of the magnetic field generator 112 may be positioned so that an axial axis 126, 226 of the core 116 is offset from, but may be substantially parallel with, the separation path 110. Some deviation from parallel may be provided, as long a suitably high magnetic field strength is provided along the separation path 110 by the magnetic field generator 112 so as to constrict the arc, such as during a short circuit interrupt event. In the depicted embodiments, the separation path 110 is synonymous with a current flow direction of the arc upon separation. In some embodiments, the axial axis 126, 226 of the core 116 may be tilted slightly from the separation path 110 by as much as about +/−10 degrees, or even +/−15 degrees and still be effective.

The magnetic field along the separation path 110 is generated by the magnetic field generator 112 as current passes through the line conductor 223 and coil of wire 118 therein. The magnetic field produced in the core 116 may have a magnetic field strength of greater than about 1 Tesla, greater than about 1.5 Tesla, and between about 1.6 and 1.8 Tesla in some embodiments. In another measure, a suitable magnetic field strength should be sufficient to constrict the arc upon separation. If the arc voltage upon contact separation is increased, then current may be limited and the downstream load (e.g., equipment) can be better protected. The axially-acting magnetic field may also cause arc rotation, which may reduce contact erosion.

As shown in FIG. 3, an electrical device comprising a circuit breaker 300 is illustrated. Circuit breaker 300 may be a molded case circuit breaker having a rating of between about 15 A and 30 A, for example. An electrical device contact assembly 100 including a magnetic field generator 112 configured as part of a line conductor as previously described is added in the circuit breaker 300. Otherwise, the circuit breaker 300 includes conventional breaker components. For example, line connector 222, load terminal connector 328, load conductor 329 (e.g., metal strap), bimetal and magnet assembly 340, latch 342, cradle 344 pivotal about cradle pivot 345, braided conductor 346, handle 347, and a spring 349 coupled between cradle 344 and contact arm 311 are entirely conventional and will not be explained in further detail.

Figure 4:
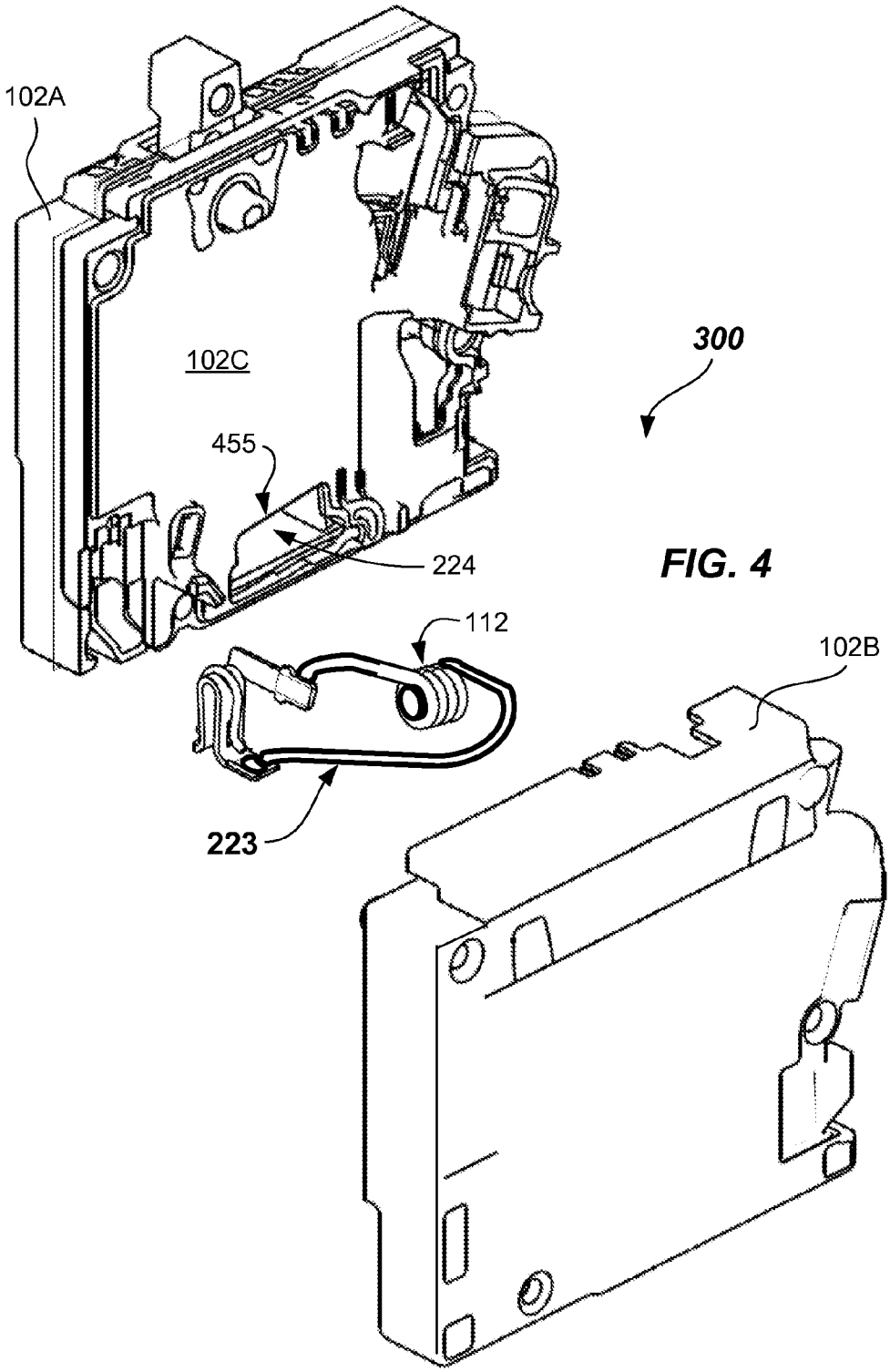
FIG. 4 illustrates an exploded perspective view of a circuit breaker including an electrical device electrical contact assembly with a magnetic field generator according to embodiments.

FIG. 4 illustrates a circuit breaker 300 and its components and one possible assembly of components thereof. The circuit breaker includes a first housing part 102A including circuit breaker components as shown in FIG. 3. Second housing part 102B connects to first housing part 102A with intermediate housing part 102C positioned in between. Line conductor 223 may be installed as a separate component whereas the magnetic field generator 112 formed by a portion the line conductor 223 may be received in side chamber 224, such as through cut-away 455 in the intermediate housing part 102C.

Figure 5:
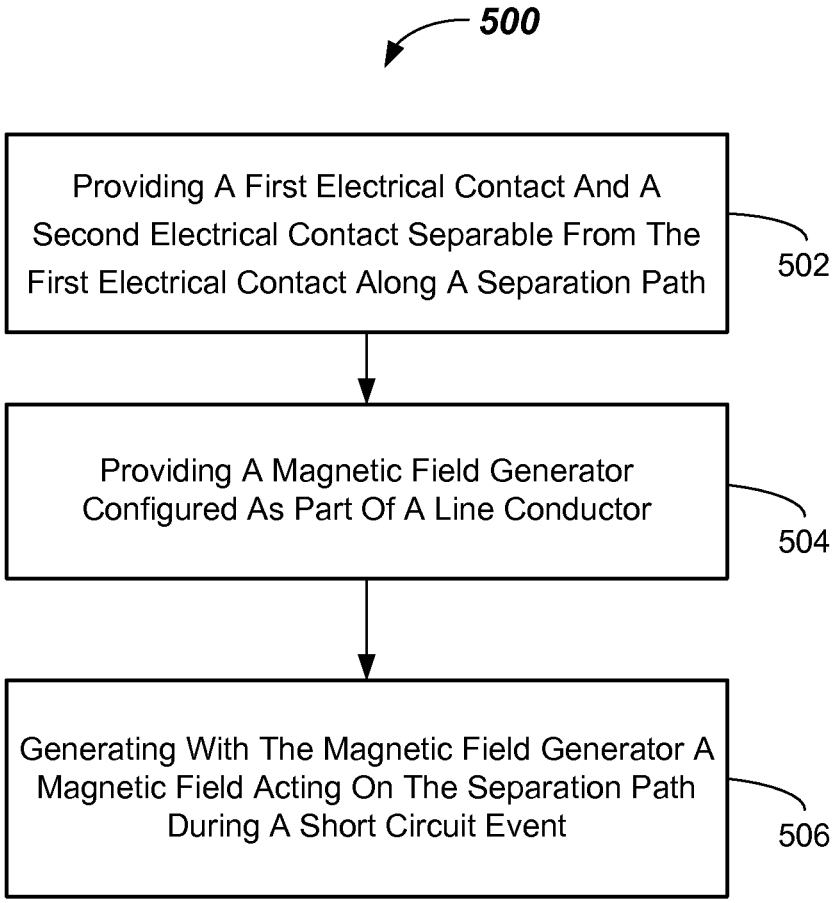
FIG. 5 illustrates a flowchart of a method of operating an electrical device contact assembly according to embodiments.

According to another aspect, a method of operating an electrical device contact assembly is provided. As shown in FIG. 5, the method 500 includes, in 502, providing a first electrical contact and a second electrical contact separable from the first electrical contact along a separation path, and in 504, providing a magnetic field generator configured as part of a line conductor.

The method 500 also includes, in 506, generating, with the magnetic field generator, a magnetic field that acts on the separation path during a short circuit event. In operation, the magnetic field so generated is of sufficient strength so as to constrict the arc during the short circuit event.

In some embodiments, the first electrical contact 106 and the second electrical contact 108 are included in an arc chamber 104 formed in a first part (e.g., in first housing part 102A) of the housing 102, and the magnetic field generator 112 is included in a second part (e.g., in second housing part 102B) of the housing 102. Thus, the magnetic field generator 112 is positioned in one side of a housing 102 of an electrical device, and produces magnetic field lines in another side of the housing. In one embodiment, the magnetic field generator 112 is positioned to a side of an arc chamber 104 of an electrical device (see FIG. 1).

In another embodiment, the magnetic field generator 112 is positioned in a side chamber 224 in a first housing part (e.g., first housing part 102A) of a housing 102, and the first electrical contact 106 and the second electrical contact 108 are positioned in an arc chamber 204 also in the first housing part (e.g., first housing part 102A) of the housing 102 as shown in FIG. 3. In this way, the magnetic field generator 112 is positioned below and offset from the first electrical contact 106 and the second electrical contact 108 (e.g., offset below).

In each embodiment, the magnetic field generator 112 may be oriented to produce magnetic field lines 114L that are substantially parallel to the separation path 110.

While the invention is susceptible to various modifications and alternative forms, specific embodiments and methods thereof have been shown by way of example in the drawings and are described in detail herein. It should be understood, however, that it is not intended to limit the invention to the particular apparatus, systems or methods disclosed, but, to the contrary, the intention is to cover all modifications, equivalents and alternatives falling within the scope of the invention.

What is claimed is:

1. An electrical device contact assembly, comprising:

a first electrical contact;

a second electrical contact separable from the first electrical contact along a separation path; and a magnetic field generator configured as part of a line conductor and oriented and operable to produce a magnetic field including magnetic field lines acting on the separation path wherein the magnetic field lines acting on the separation path are substantially parallel to the separation path during a short circuit event.

2. The electrical device contact assembly of claim 1, wherein the first electrical contact is a stationary electrical contact and the second electrical contact is a moveable electrical contact.

3. The electrical device contact assembly of claim 1, wherein the first electrical contact and the second electrical contact are included in a housing including walls forming an arc chamber.

4. The electrical device contact assembly of claim 1, wherein the magnetic field generator comprises a core and a coil of wire of a line conductor wound about the core.

5. The electrical device contact assembly of claim 4, wherein the coil of wire is electrically connected to the first electrical contact.

6. The electrical device contact assembly of claim 4, wherein the coil of wire is electrically connected to a line connector.

7. The electrical device contact assembly of claim 4, wherein the coil of wire is electrically connected between a line connector and the first electrical contact.

8. The electrical device contact assembly of claim 1, wherein the magnetic field generator is formed by winding a portion of the line conductor about a core.

9. The electrical device contact assembly of claim 1, wherein the magnetic field generator is positioned to a side of an arc chamber of an electrical device.

10. The electrical device contact assembly of claim 1, wherein the magnetic field generator is positioned below an arc chamber of an electrical device.

11. The electrical device contact assembly of claim 1, wherein the magnetic field generator is configured and operational to provide a magnetic field strength in a core of the magnetic field generator of greater than 1 Tesla during a short circuit event.

12. An electrical device, comprising:

a housing including walls forming an arc chamber;

a first electrical contact within the arc chamber;

a second electrical contact within the arc chamber and separable from the first electrical contact along a separation path; and a magnetic field generator positioned adjacent to the arc chamber, the magnetic field generator configured as part of a line conductor and operational to produce a magnetic field including magnetic field lines acting on the separation path wherein the magnetic field lines acting on the separation path are substantially parallel to the separation path during a short circuit event.

13. A method of operating an electrical device contact assembly, comprising:

providing a first electrical contact and a second electrical contact separable from the first electrical contact along a separation path;

providing a magnetic field generator configured as part of a line conductor; and generating with the magnetic field generator a magnetic field including magnetic field lines acting on the separation path wherein the magnetic field lines acting on the separation path are substantially parallel to the separation path during a short circuit event.

14. The method of claim 13, wherein the magnetic field constricts an arc during the short circuit event.

15. The method of claim 13, wherein the magnetic field generator is included in a first part of the housing and the first electrical contact and the second electrical contact are included in an arc chamber formed in a second part of the housing.

16. The method of claim 13, positioning the magnetic field generator in a side chamber formed in a first part of a housing, and positioning the first electrical contact and the second electrical contact in an arc chamber also formed in the first part of the housing.

17. A method of operating an electrical device contact assembly, comprising:

providing a first electrical contact and a second electrical contact separable from the first electrical contact along a separation path;

providing a magnetic field generator configured as part of a line conductor;

generating with the magnetic field generator a magnetic field acting on the separation path during a short circuit event wherein the magnetic field generator is oriented to produce magnetic field lines that are substantially parallel to the separation path; and positioning the magnetic field generator in one side of a housing of an electrical device, and producing the magnetic field lines in another side of the housing.

* * * * *